US010959486B2

(12) United States Patent
Shah

(10) Patent No.: US 10,959,486 B2
(45) Date of Patent: Mar. 30, 2021

(54) SHOE WITH SOLE PIVOT

(71) Applicant: Leelayan, Inc., Bloomfield Hills, MI (US)

(72) Inventor: Jayprakash Shah, Bloomfield Hills, MI (US)

(73) Assignee: LEELAYAN, INC., Bloomfield Hills, MI (US)

( * ) Notice: Subject to any disclaimer, the term of this patent is extended or adjusted under 35 U.S.C. 154(b) by 36 days.

(21) Appl. No.: 16/411,414

(22) Filed: May 14, 2019

(65) Prior Publication Data

US 2019/0350309 A1 Nov. 21, 2019

Related U.S. Application Data

(60) Provisional application No. 62/674,085, filed on May 21, 2018.

(51) Int. Cl.
*A43B 13/14* (2006.01)
*A43B 13/16* (2006.01)

(52) U.S. Cl.
CPC ..... *A43B 13/141* (2013.01); *A43B 13/16* (2013.01)

(58) Field of Classification Search
None
See application file for complete search history.

(56) References Cited

U.S. PATENT DOCUMENTS 474,574 A * 5/1892 Bruzon ..... A43B 11/02 36/138
638,297 A 12/1899 Thompson
955,337 A * 4/1910 Lowlor ..... A43B 11/00 36/105
2,125,623 A 8/1938 Clausing
3,464,126 A 9/1969 Sarkissian
3,645,017 A 2/1972 Hickmann
4,575,957 A 3/1986 Petrini
4,944,099 A * 7/1990 Davis ..... A43B 3/26 36/102
5,184,410 A 2/1993 Hamilton
(Continued)

FOREIGN PATENT DOCUMENTS

JP 2002199901 A 7/2002
JP 2003070502 A 3/2003
(Continued)

*Primary Examiner* — Jila M Mohandesi
(74) *Attorney, Agent, or Firm* — Blue Filament Law PLLC

(57) ABSTRACT

The pivotable footwear including a front portion, a heel portion, a flexible sole defining a channel extending across the flexible sole, a shoe upper attached to the flexible sole, and a lockable hinge mechanism disposed within the channel. The lockable hinge has an unlocked position wherein the heel portion of said footwear is free to pivot about the channel relative to the front portion of the footwear, and a locked position wherein the heel portion of the footwear is locked into position relative to the front portion of said footwear. The lockable hinge mechanism is electronically actuated and battery operated and controlled to move between the locked position and the unlocked position by actuation of an electronic remote control. That is, actuation of the electronic remote control causes the hinge to move the footwear to an open, foot insertion position and a wearable locked position.

17 Claims, 5 Drawing Sheets

(56) References Cited

U.S. PATENT DOCUMENTS

| | | | | |
|---|---|---|---|---|
| 5,412,883 | A | 5/1995 | Wulf et al. | |
| 5,481,814 | A | 1/1996 | Spencer | |
| 6,189,239 | B1 | 2/2001 | Gasparovic | |
| 6,588,125 | B2 | 7/2003 | Proctor, Sr. | |
| 7,793,438 | B1 * | 9/2010 | Busse | A43B 11/02 36/105 |
| 8,245,421 | B2 * | 8/2012 | Baudouin | A43B 11/00 36/103 |
| 8,635,791 | B2 | 1/2014 | Baudouin et al. | |
| 9,119,437 | B2 | 9/2015 | Weller et al. | |
| 2004/0013849 | A1 * | 1/2004 | Kobayashi | A47L 23/266 428/95 |
| 2005/0076540 | A1 * | 4/2005 | Su | A43B 11/00 36/105 |
| 2008/0168683 | A1 | 7/2008 | Keating | |
| 2010/0184563 | A1 * | 7/2010 | Molyneux | A43B 3/0005 482/1 |
| 2010/0319216 | A1 | 12/2010 | Grenzke et al. | |
| 2011/0146106 | A1 * | 6/2011 | Kaufman | A43C 11/008 36/105 |
| 2014/0298687 | A1 | 10/2014 | Flinterman et al. | |
| 2015/0047223 | A1 | 2/2015 | Flinterman et al. | |
| 2015/0157087 | A1 * | 6/2015 | Blumenthal | A43B 3/24 36/100 |
| 2015/0216252 | A1 * | 8/2015 | Wiens | A43B 11/00 36/105 |
| 2015/0223554 | A1 | 9/2015 | Ardell et al. | |
| 2015/0374065 | A1 | 12/2015 | DiFrancisco | |
| 2016/0374427 | A1 | 12/2016 | Zahabian | |
| 2017/0049190 | A1 | 2/2017 | Maussen | |
| 2018/0217662 | A1 * | 8/2018 | Smoot | G06F 3/0334 |

FOREIGN PATENT DOCUMENTS

| | | | |
|---|---|---|---|
| WO | 2000074514 | A1 | 12/2000 |
| WO | 2010048203 | A1 | 4/2010 |
| WO | 2014038937 | A1 | 3/2014 |
| WO | 2014140443 | A | 9/2014 |

* cited by examiner

SHOE WITH SOLE PIVOT

CROSS-REFERENCE TO RELATED APPLICATION

This application claims priority of U.S. Provisional Patent Application Ser. No. 62/674,085 filed May 21, 2018, which is incorporated herein by reference.

FIELD OF THE INVENTION

The present invention relates to footwear, and more particularly to footwear construction that pivots at the sole to move between an open, foot insertion position and a closed, wearable position.

BACKGROUND OF THE INVENTION

There are numerous circumstances whereby a person is unable to bend down to put on a pair of shoes. Injury, disease, arthritis, obesity and surgery are a few of the reasons why it is desirable to provide a simple and easy way to put on an article of footwear without the use of one's hands or the necessity of bending down. Additionally, some users attempt to push their foot into tight footwear opening, which overtime wears down the heel and ankle part of the footwear, reducing the support provided by the footwear and eventually destroying the footwear over time. This problem is not new and numerous appliances have been devised to overcome it.

For example, elongated shoe horns are often used to attempt to hold the opening of a shoe open and provide a smooth path for inserting one's foot into the shoe. Unfortunately, most footwear openings are too small and require hand manipulation and strength to push one's foot into position within the footwear, even with the use of a shoe horn. Additionally, shoe horns require a degree of strength, coordination, and often bending over to successfully insert one's foot into a shoe properly. As such, the elongated shoe horn is not helpful to many people who cannot reach down or those suffering from a condition that limits their strength and coordination.

A number of articles of footwear have been developed to enable a user to enlarge the opening of the footwear for easier foot insertion, for example by providing a shoe that separates and pivots at a hinged heel and is biased by springs to return to a wearable position once on a user's foot or that is held together in a wearable position by hook and loop fasteners, buckles, or other locking mechanisms. However, such designs still require considerable strength to overcome the spring bias to open the shoe and hold it open whilst inserting one's foot, coordination to manipulate any securing hook and loop fasteners, buckles, or locking mechanisms, or the ability to bend down to position the open shoe relative to one's foot. Additionally, such designs are often awkward to walk in given that forces on the footwear from the movement of the foot during walking can affect the biased springs, resulting in a tightening and loosening of the footwear, which can be uncomfortable and even dangerous to the user.

Thus, there exists a need for a shoe that easily moves between an open, foot insertion position and a closed, wearable position without requiring a user to open, hold open, or close the footwear by hand and that remains securely in the closed, wearable position during walking use.

SUMMARY OF THE INVENTION

A footwear construction that pivots at the sole to move between an open, foot insertion position and a closed, wearable position is provided. The footwear includes a front portion, a heel portion, a flexible sole defining a channel extending across the flexible sole, a shoe upper attached to the flexible sole, and a lockable hinge mechanism disposed within the channel. The lockable hinge has an unlocked position wherein the heel portion of the footwear is free to pivot about the channel relative to the front portion of the footwear, and a locked position wherein the heel portion of the footwear is locked into position relative to the front portion of said footwear. According to embodiments, the lockable hinge mechanism is electronically actuated and battery operated. In some embodiments, the battery is rechargeable. According to embodiments, the electronically actuated and battery operated lockable hinge mechanism is controlled to move between the locked position and the unlocked position by actuation of an electronic remote control. That is, actuation of the electronic remote control causes the hinge to move the footwear to an open, foot insertion position and to a closed, wearable position.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DESCRIPTION OF THE PREFERRED EMBODIMENTS

Figure 1:
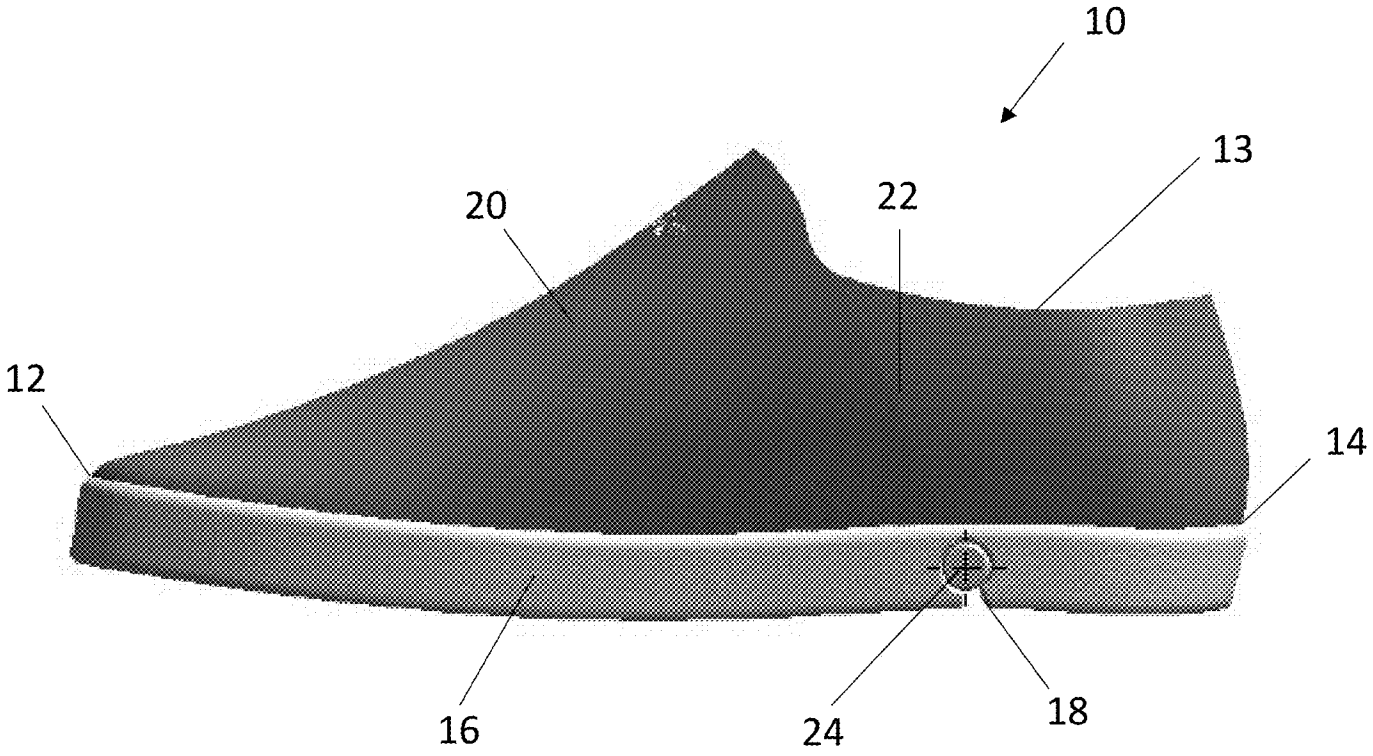
FIG. 1 is a side view of a footwear with a sole pivot in a closed, wearable position according to forms of the present disclosure.

The present invention has utility as a footwear that easily moves between an open, foot insertion position and a closed, wearable position without requiring a user to open, hold open, or close the footwear by hand and that remains securely in the closed, wearable position during walking use.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. It is important, therefore, that the claims be regarded as including such equivalent constructions insofar as they do not depart from the spirit and scope of the present invention. Also, it is to be understood that the phraseology and terminology employed herein are for the purpose of description and should not be regarded as limiting.

The present invention is described with respect a shoe as an exemplary form of footwear. Footwear as used herein includes, shoes, boots, sandals, moccasins, chappals, slippers, and loafers.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

An embodiment of the inventive footwear 10 with pivoting sole is shown in FIG. 1. The footwear 10 includes a front portion 12 and a heel portion 14. The footwear 10 is configured to receive a foot of a user via an opening 13 in the footwear 10. When positioned on the user's foot, the front part of the user's foot including toes is positioned in the front portion 12 of the footwear 10 and the heel and ankle portion of the user's foot is positioned in the heel portion 14 of the footwear 10.

The inventive footwear 10 also includes a flexible sole 16. The flexible sole defines a channel 18 that extends across the width of the sole 16 of the footwear 10. The sole 16 is formed of a resilient yet flexible material. According to some embodiments, the sole 16 is formed of a rubber material. According to some embodiments of the present disclosure, the sole 16 is integrally formed such that a front portion of the sole 16 and a heel portion of the sole 16 are interconnected other than at the channel 18 defined within the sole 16. A bottom portion of the sole 16 may include a slip-resistant tread.

The inventive footwear 10 has a footwear upper 20 attached to the sole 16. The opening 13 of the footwear 10 is positioned in the shoe upper 20 for receiving a user's foot. The shoe upper 20 is configured to securely retain the user's foot within the footwear 10. According to embodiments of the present disclosure, the shoe upper 20 is integrally formed such that a front portion of the shoe upper 20 and a heel portion of the shoe upper 20 are interconnected. According to various forms or the present disclosure, the shoe upper 20 is unitary. The shoe upper 20 may be formed of a stretchable material. According to embodiments, the shoe upper 20 has a stretchable region 22. That is, according to some embodiments, a majority of the shoe upper 20 is formed for a material that is generally not considered to be stretchy or a material that is less stretchable than the material forming the stretchable region 22, but a stretchable region 22 of the shoe upper 20 is formed of a stretchable material. In such embodiments, the stretchable region 22 of the shoe upper 20 is positioned proximate to the channel 18 defined in the sole 16. That is, the stretchable region 22 is positioned above the channel 18. According to embodiments of the present disclosure, the inventive footwear 10 includes at least two stretchable regions 22, one on each side of the footwear 10, that is a right and left side of the footwear 10.

Figure 2:
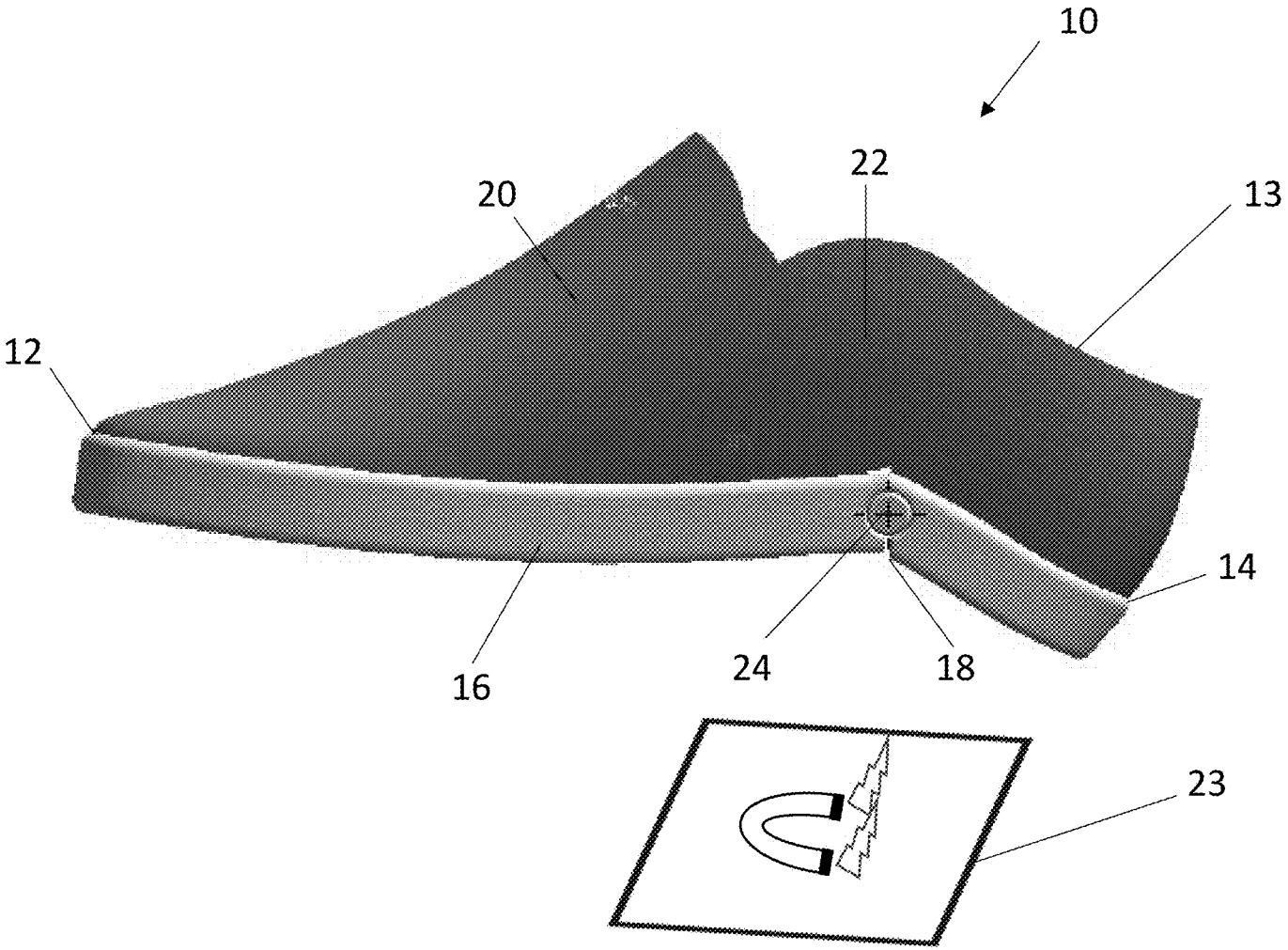
FIG. 2 is a side view of the footwear of FIG. 1 in an open, foot insertion position.
Figure 3A:
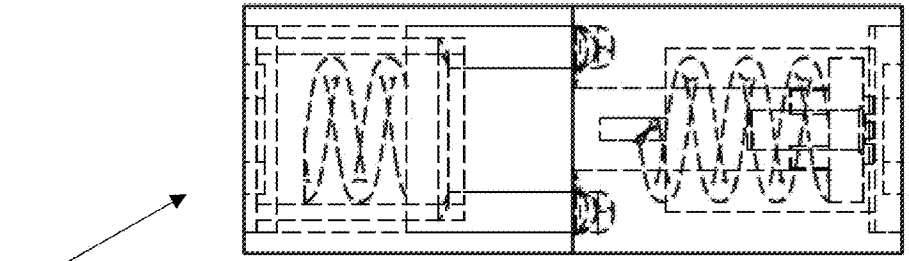
FIG. 3A is a top view of lockable hinge mechanism of a footwear with a sole pivot according to forms of the present disclosure.
Figure 3B:
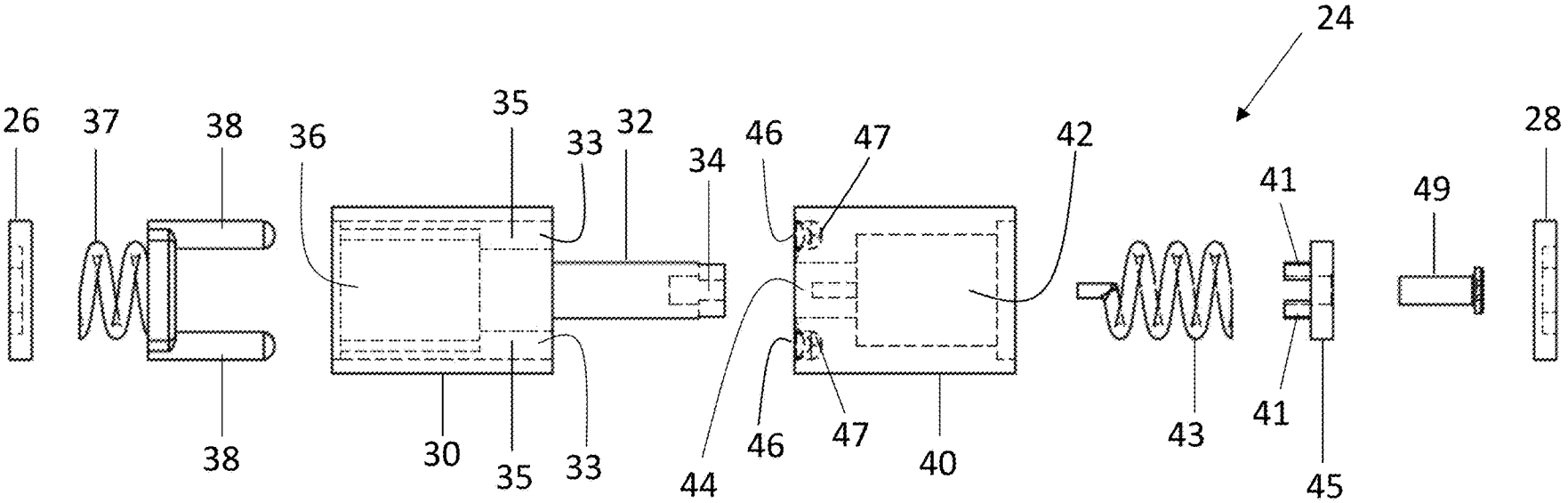
FIG. 3B is an exploded top view of the lockable hinge mechanism of FIG. 3A.
Figure 3C:
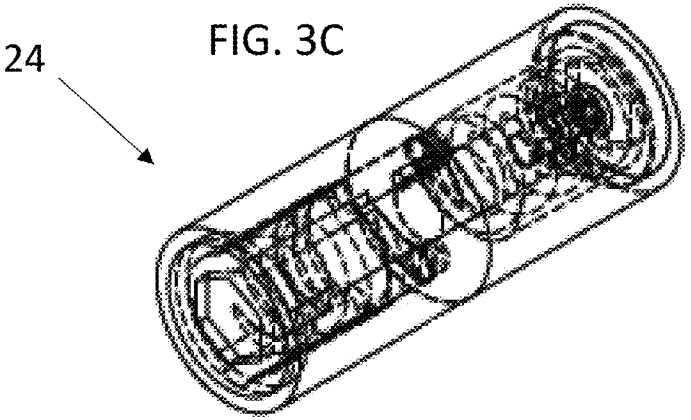
FIG. 3C is a right perspective view of the lockable hinge mechanism of FIG. 3A.
Figure 3D:
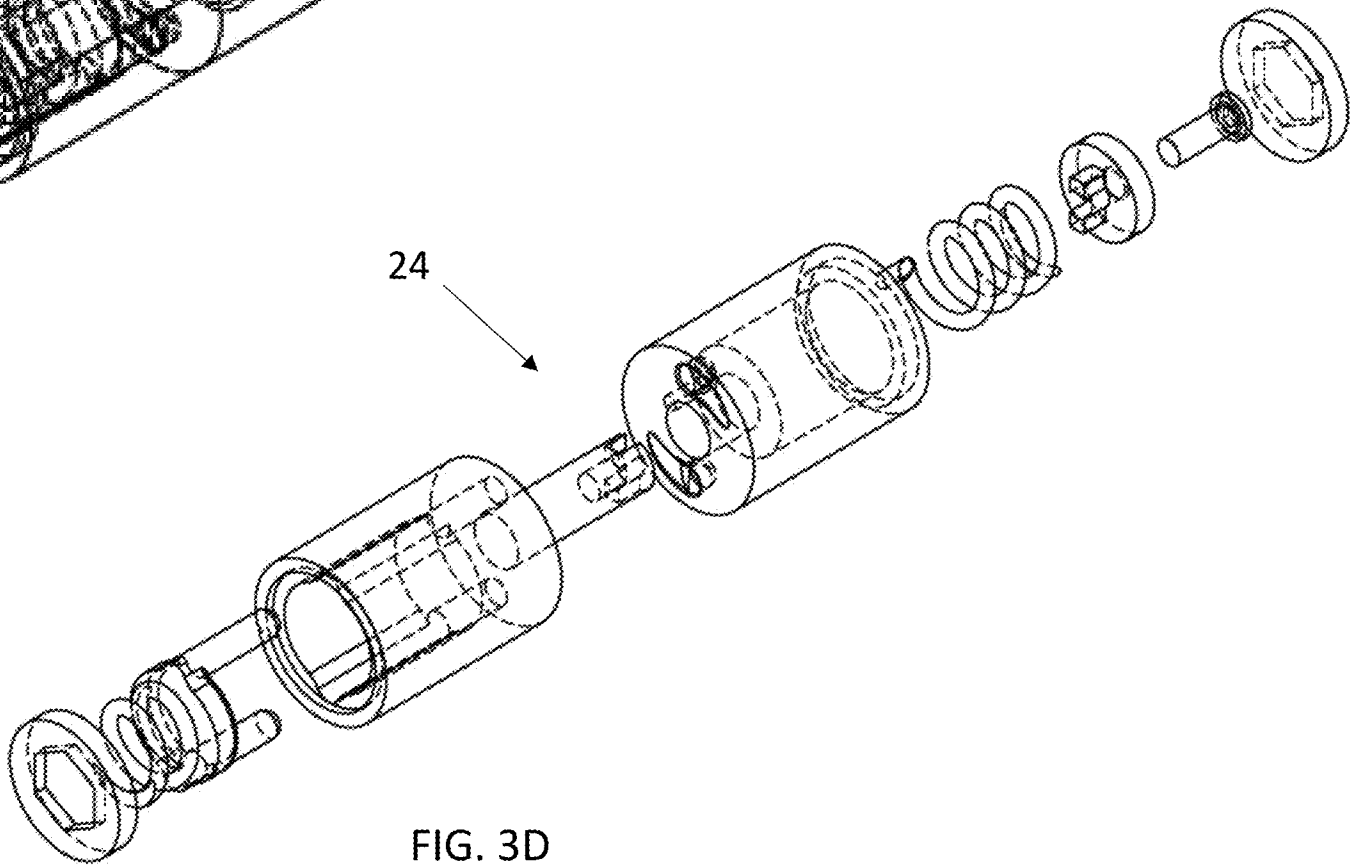
FIG. 3D is an exploded view of the lockable hinge mechanism of FIG. 3C.
Figure 3E:
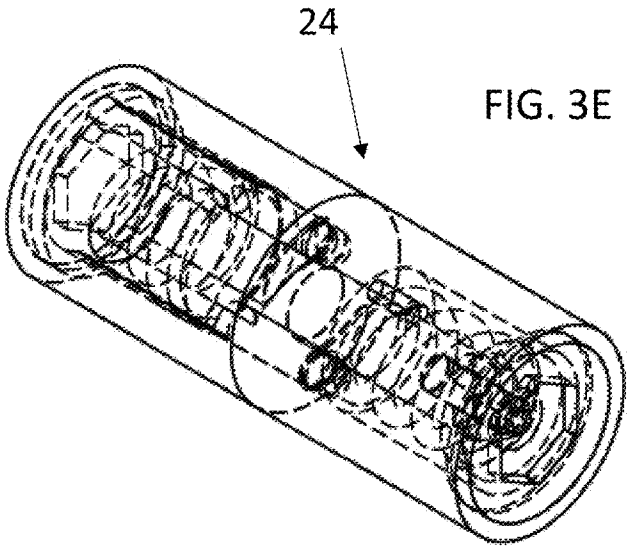
FIG. 3E is a left perspective view of the lockable hinge mechanism of FIG. 3A.
Figure 3F:
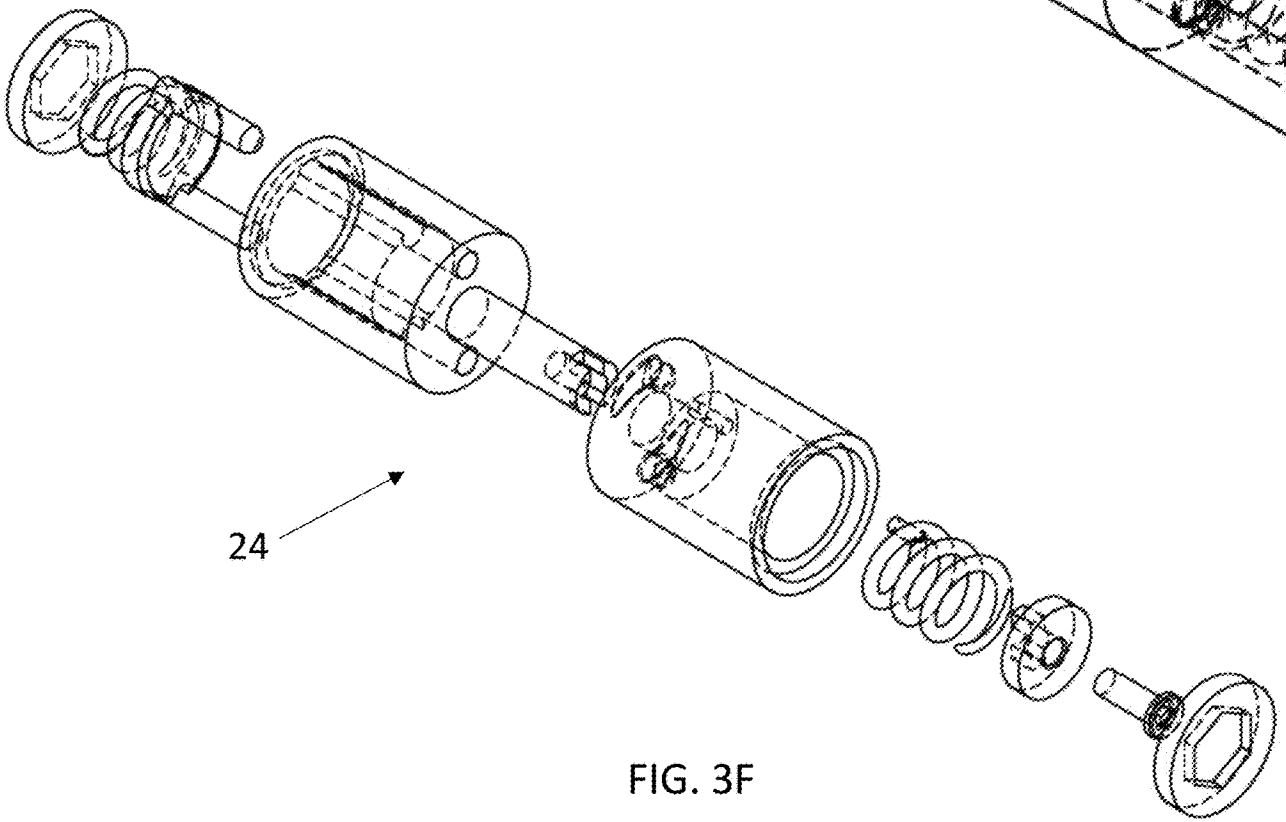
FIG. 3F is an exploded view of the lockable hinge mechanism of FIG. 3E.

The inventive footwear 10 is configured to move between a closed, wearable position, as shown in FIG. 1, and an open, foot insertion position, as shown in FIG. 2. In the open position of FIG. 2, the heel portion 14 of the footwear 10 pivots down, away from the front portion 12 of the footwear 10 at the channel 18 in the flexible sole 16. While pivoting at the sole 16, the attached shoe upper 20 stretches as it moves with the heel portion of the sole 16. The stretching of the shoe upper 20 enlarges the opening 13 in the footwear, making it easier to insert the foot of a user. Once the user's foot is comfortably positioned within the front portion 12 of the footwear 10, the heel portion 14 of the footwear 10 pivots up, toward the front portion 12 of the footwear 10 at the channel 18 in the flexible sole 16 to return the footwear 10 to the closed, wearable position of FIG. 1, bringing the heel portion 14 of the footwear 10 into contact with the heel and ankle region of the user's foot. According to embodiments, the footwear 10 is moved from the open, foot insertion position to the closed, wearable position by the user stepping down on the heel portion 14 of the footwear 10.

The inventive footwear 10 further includes a lockable hinge mechanism 24. The lockable hinge mechanism 24 is disposed within the channel 18 of the flexible sole 16. The lockable hinge mechanism 24 is configured to hold the footwear 10 in the closed, wearable position. According to some embodiments, the lockable hinge mechanism 24 is also configured to force the footwear 10 into the open, foot insertion position and hold the footwear 10 in the open, foot insertion position. The lockable hinge mechanism 24 has an unlocked position and a locked position. When the lockable hinge mechanism 24 is in the unlocked position the heel portion 14 of the footwear 10 is free to pivot about the channel 18 relative to the front portion 12 of the footwear 10 to move the footwear 10 into the open, foot insertion position of FIG. 2. When the lockable hinge mechanism 24 is in the locked position, the heel portion 14 of the footwear 10 is locked into position relative to the front portion 12 of the footwear 10 to hold the footwear in the closed, wearable position of FIG. 1. According to some embodiments, the inventive footwear 10 includes a lockable hinge mechanism 24 on both sides of the footwear 10, that is on the left side and right side of the footwear 10 within the channel 18.

As shown in FIGS. 3A-3F, a lockable hinge mechanism 24 according to the present disclosure includes a locking pin hub 30 and a positioning hub 40 positioned in an abutting relationship. The locking pin hub 30 has an axial pin 32 protruding and extending from one end of the locking pin hub 30. The free end of the axial pin 32 defines a channel 34. The locking pin hub 30 defines a chamber 36 configured to receive a coil spring 37 with integrally formed locking pins 38. The locking pins 38 are received within locking pin channels 35 within the chamber 36 of the locking pin hub 30. The locking pin channels 35 are open at both ends such that the locking pins 38 are free to protrude from the locking pin hub 30 through holes 33. The spring coil 37 is covered by a first button 26 that is disposed at the open end of the chamber 36 of the locking pin hub 30. The positioning hub 40 defines a chamber 42 therein at one end and a pin receiving tube 44 at a second end, which are in fluid communication. The pin receiving tube 44 is configured to receive the axial pin 32 of the locking pin hub 30. The axial pin 32 passes through the pin receiving tube 44 and extends into the chamber 42 of the positioning hub 40. The positioning hub 40 also includes flared holes 46 that are sized to receive the tips of the locking pins 38 in the locking ends 47. The chamber 42 is configured to receive a coil spring 43, which sits around the outside of the pin 32 within the chamber 42. A spring cap 45 covers the coil spring 43 at the open end of the chamber 42. The spring cover 45 has prongs 41 that engage with the channel 34 in the free end of the axial pin 32. A fastener 49 passes through a hole in the spring cover 45 and secures the spring cover to the axial pin 32 of the locking pin hub 30. A second button is disposed at the open end of the chamber 42. Pushing the first button 26 compresses the coil spring 37 thereby forcing the locking pins 38 through the holes 33 in the end of the locking pin hub 30. The locking pins 38 travel in the smaller portion of the flared holes 46 thereby rotating the positioning hub 40 until the ends of the locking pins 38 snap into the locking ends 47 of the flared holes 46.

According to embodiments, the lockable hinge 24 is push button activated by pushing the first button 26 and pushing the button 26 locks the hinge mechanism into the locked position. According to embodiments, the lockable hinge 24 is electronically actuated and battery operated. In such embodiments, the battery for operating the lockable hinge mechanism 24 may be embedded in the flexible sole 16 of the footwear 10. The battery may be replaceable or rechargeable. In some embodiments, the electronically actuated lockable hinge mechanism 24 is controlled between the unlocked position and the locked position by actuation of an electronic remote control. In such embodiments, actuation of a button on a remote control causes the hinge 24 to move the footwear 10 to the open, foot insertion position of FIG. 2 so that a user can insert his or her foot. Once the user's foot is positioned within the footwear 10, a button on the remote control can again be actuated to control hinge 24 such that the footwear 10 to moves to the closed, wearable position. Accordingly, a user need not bend down to even touch the footwear 10 in order to use and wear the inventive footwear 10. In various embodiments of the present disclosure, the lockable hinge mechanism 24 is magnetically actuated between the unlocked position and the locked position. In such embodiments, the lockable hinge mechanism 24 is locked into the locked position by bringing the footwear 10 into proximity with a magnet, for example a magnetic mat such as a floor mat 23.

According to embodiments of the present disclosure, the heel portion 14 of the footwear 10 is free to pivot up to 45 degrees relative to the front portion 12 of the footwear 10 when the lockable hinge mechanism 24 is in the unlocked position. According to embodiments, the lockable hinge mechanism has an outer diameter of 0.5 inches. In such embodiments, the heel portion 14 of the footwear 10 is free to pivot up to 10 degrees relative to the front portion 12 of the footwear 10 when the lockable hinge mechanism 24 is in the unlocked position. According to the present disclosure, the heel portion 14 of the footwear 10 is thought to be in line with or in a zero degree relationship with the front portion 12 of the footwear when the lockable hinge mechanism 24 is in the locked position.

Although the present invention has been described with reference to preferred embodiments, numerous modifications and variations can be made and still the result will come within the scope of the invention. No limitation with respect to the specific embodiments disclosed herein is intended or should be inferred.

The invention claimed is:

1. An article of footwear having a front portion and a heel portion, the article of footwear comprising:

a flexible sole defining a channel extending within said flexible sole;

a stretchable unitary shoe upper attached to said flexible sole;

a lockable hinge mechanism disposed within the channel, said lockable hinge having an unlocked position wherein the heel portion of said footwear is free to pivot about the channel relative to the front portion of said footwear, and a locked position wherein the heel portion of said article of footwear is locked into position relative to the front portion of said footwear; and a spring within the channel biased to pivot the heel portion relative to the front portion.

2. The article of footwear of claim 1 wherein said lockable hinge mechanism is a push button activated hinge.

3. The article of footwear of claim 2 wherein pressing a push button of the push button activated hinge moves said hinge mechanism between the locked position and the unlocked position.

4. The article of footwear of claim 1 wherein said lockable hinge mechanism is electronically actuated and battery operated.

5. The article of footwear of claim 4 wherein said lockable hinge mechanism moves between the locked position and the unlocked position by actuation of an electronic remote control.

6. The article of footwear of claim 5 wherein actuation of the electronic remote control causes the hinge to move said article of footwear to an open, foot insertion position.

7. The article of footwear of claim 5 wherein actuation of the electronic remote control causes the hinge to move said article of footwear to a closed, wearable position.

8. The article of footwear of claim 1 wherein said lockable hinge mechanism is magnetically actuated between the unlocked position and the locked position.

9. The article of footwear of claim 8 wherein said lockable hinge mechanism is locked into the locked position when said article of footwear is brought into proximity with a magnetic mat.

10. The article of footwear of claim 1 wherein when said lockable hinge mechanism is in the unlocked position the heel portion of said article of footwear is free to pivot up to 45 degrees relative to the front portion of said article of footwear.

11. The article of footwear of claim 1 wherein said lockable hinge mechanism has a diameter of 0.5 in.

12. The article of footwear of claim 11 wherein when said lockable hinge mechanism is in the unlocked position the heel portion of said article of footwear is free to pivot up to 10 degrees relative to the front portion of said article of footwear.

13. The article of footwear of claim 1 wherein said flexible sole is integrally formed.

14. The article of footwear of claim 1 wherein said flexible sole is formed of a rubber material.

15. The article of footwear of claim 1 wherein said shoe upper is integrally formed.

16. The article of footwear of claim 1 wherein said shoe upper is formed of a stretchable material.

17. The article of footwear of claim 1 wherein said shoe upper has a stretchable region positioned proximate to the channel defined in said flexible sole.

* * * * *